US007607528B2

(12) United States Patent
Derks et al.

(10) Patent No.: US 7,607,528 B2
(45) Date of Patent: Oct. 27, 2009

(54) METHOD AND DEVICE FOR CHECKING BANKNOTES

(75) Inventors: Hendrik Derks, Geretsried (DE); Matthias Hecht, Ottobrunn (DE); Norbert Holl, Germering (DE); Nikolai Lipkowitsch, München (DE); Dieter Stein, Holzkirchen (DE); Holger Trumpfheller, München (DE); Bernd Wunderer, München (DE)

(73) Assignee: Giesecke & Devrient GmbH, Munich (DE)

( * ) Notice: Subject to any disclaimer, the term of this patent is extended or adjusted under 35 U.S.C. 154(b) by 547 days.

(21) Appl. No.: 10/539,796

(22) PCT Filed: Dec. 16, 2003

(86) PCT No.: PCT/EP03/14334

§ 371 (c)(1),
(2), (4) Date: Oct. 27, 2005

(87) PCT Pub. No.: WO2004/055740

PCT Pub. Date: Jul. 1, 2004

(65) Prior Publication Data

US 2006/0151282 A1 Jul. 13, 2006

(30) Foreign Application Priority Data

Dec. 18, 2002 (DE) ..... 102 59 288

(51) Int. Cl.
*G07F 7/04* (2006.01)

(52) U.S. Cl. ..... 194/206; 209/534

(58) Field of Classification Search ..... 194/206, 194/207; 209/534

See application file for complete search history.

(56) References Cited

U.S. PATENT DOCUMENTS

| | | | | | |
|---|---|---|---|---|---|
| 4,697,650 | A * | 10/1987 | Fontenot | 175/50 |
| 5,295,196 | A * | 3/1994 | Raterman et al. | 382/135 |
| 5,922,959 | A | 7/1999 | Kayani | |
| 5,931,277 | A * | 8/1999 | Allan et al. | 194/317 |
| 6,636,615 | B1 * | 10/2003 | Rhoads et al. | 382/100 |
| 2002/0043560 | A1 | 4/2002 | Woods et al. | |
| 2002/0056605 | A1 * | 5/2002 | Mazur et al. | 194/207 |
| 2007/0095630 | A1 * | 5/2007 | Mennie et al. | 194/206 |

FOREIGN PATENT DOCUMENTS

| | | |
|---|---|---|
| EP | 1 172 773 A1 | 1/2002 |
| WO | 01 54076 A1 | 7/2001 |

* cited by examiner

*Primary Examiner*—Jeffrey A Shapiro
(74) *Attorney, Agent, or Firm*—Bacon & Thomas, PLLC

(57) ABSTRACT

A method and an apparatus for checking bank notes, in which data from at least two different measurings of the bank notes to be checked are evaluated. Bank notes are checked, whereby data from at least two different measurings of bank notes to be checked are evaluated, a first property of the bank note to be checked being derived from the data of at least one first measuring, at least one second property of the bank note to be checked being derived from the data of at least one second measuring. A correlation between the first and the second property for the same places on the bank note to be checked is determined, and the first property is derived once again. For the places of the bank note to be checked, for which a correlation between first and at least second property has been determined, an altered derivation of the first property from the data of the at least first measuring is performed.

16 Claims, 2 Drawing Sheets

METHOD AND DEVICE FOR CHECKING BANKNOTES

BACKGROUND

A. Field

The present invention relates to a method and an apparatus for checking bank notes, with which data from at least two different measurings of the bank notes to be checked are evaluated.

B. Related Art

The checking of bank notes usually is carried out with the help of sensors, which capture data that represent certain properties of bank notes. The data of each sensor normally are evaluated independently of the data coming from the other sensors.

From EP 1 172 773 A1 an apparatus and a method for checking the authenticity of documents is known, in which the data of an optical sensor are used for determining the position of a magnetic security thread. The position of the security thread determined by the optical sensor is used for selectively actuating a magnetic sensor, so that this magnetic sensor can readout the coding contained in the security thread exactly at the position of the security thread.

The known methods and apparatuses for checking bank notes do not render any statements on how the checking of bank notes by means of at least two different measurings of the bank notes to be checked can be improved, when at least one of the different measurings contains information or data that can lead to an incorrect checking.

Therefore, it is the problem of the present invention to specify a method and an apparatus for checking bank notes, with which data from at least two different measurings of the bank notes to be checked are evaluated, an incorrect checking on the basis of the evaluation of the data of the at least two different measurings being avoided.

SUMMARY OF THE INVENTION

The invention starts out from a checking of bank notes, with which data from at least two different measurings of bank notes to be checked are evaluated, a first property of the bank note to be checked being derived from the data of at least one first measuring, at least one second property of the bank note to be checked being derived from the data of at least one second measuring, a correlation between first and at least second property for the same places on the bank note to be checked being determined, and the first property being derived once again, for the places of the bank note to be checked, for which a correlation between first and at least second property has been determined, an altered derivation of the first property from the data of the at least first measuring being performed. In connection with the present invention correlation shall not solely mean the formation of a correlation function, but every local or not-local arithmetical or logical connection of data or of properties derived from this data.

The invention thus in particular has the advantage, that because the altered derivation disturbing information in the data evaluated for the purpose of checking bank notes can be suppressed, the quality and plausibility of the checking is improved. This allows a reliable evaluation of the features and/or properties of the bank notes to be checked, whereas with only one measuring or with two isolated measurings of the features and/or properties there can occur problems, e.g. because the captured features and/or properties are not unambiguous.

DESCRIPTION OF THE DRAWINGS

Further advantages of the present invention appear from the dependent claims as well as the following description of one embodiment with reference to Figures.

DETAILED DESCRIPTION OF PREFERRED EMBODIMENTS

Figure 1:
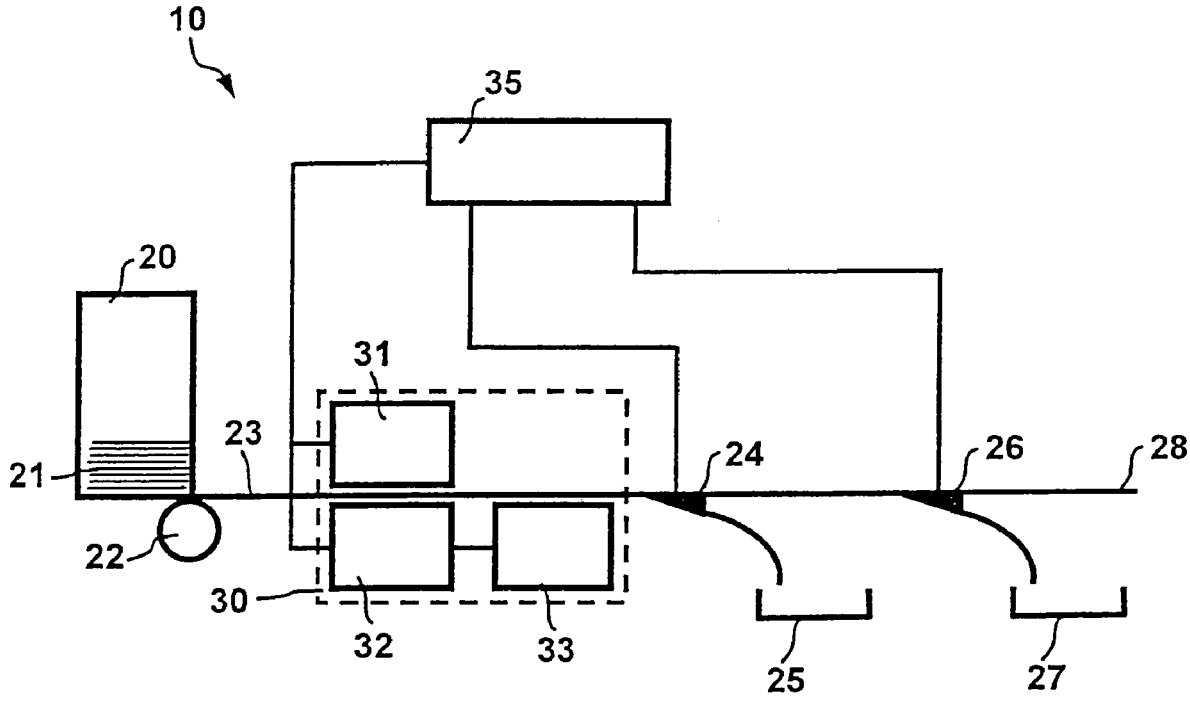
FIG. 1 shows a schematic representation of a basic structure of an apparatus for the checking of bank notes.

FIG. 1 shows a schematic representation of a basic structure of an apparatus 10 for checking bank notes.

The apparatus 10 for checking is formed as a bank note processing machine and has an input pocket 20 for feeding bank notes 21 to be processed, into which a singler 22 engages. The singler 22 seizes one of the bank notes 21 to be processed and transfers the individual bank note to a transport system 23, which transports the individual bank note through a sensor arrangement 30.

In this sensor arrangement 30 there are at least two different sensors 31, 32, 33, for example a first optical sensor 31, which captures light reflected by the bank note, a second acoustic sensor 33, which captures in particular transmitted ultrasonic signals coming from the bank note, and a third optical sensor 32, which captures light transmitted by the bank note. The sensors 31, 32, 33 perform a measuring for the purpose of checking bank notes, during which they capture features and/or properties of each individual bank note and generate respective data. For this purpose the sensors 31, 32, 33 detect the bank notes with a given resolution, from which results a pixel size with which the bank notes are scanned and captured.

From the captured pixels of each bank note the sensors 31, 32, 33 and/or a control device 35 generate data, which represent each place on the surface of the respective bank note. The generation of the data by the sensors 31, 32, 33 e.g. can be performed for only one side of the bank notes, i.e. for one of the surfaces of the bank notes, however, likewise the two surfaces can be captured and the respective data are made available thereby. Preferably, the sides or surfaces of the bank notes each are completely scanned and then the respective data for the complete side or surface are generated.

From the data generated by the sensors 31, 32, 33 properties are derived, which are relevant for checking bank notes. These properties can relate to, for example, authenticity, kind (currency, denomination), state (damage, soiling) etc. of the respective bank note. The respective properties can be derived, for example, from the data of one or a plurality of sensors 31, 32, 33.

In the control device 35 the data of the sensors 31, 32, 33 are compared to reference data stored within the control device 35, which allow the recognition of authentic or counterfeited bank notes and/or bank notes suspected of forgery, the kind of bank notes, state of bank notes etc.

On the basis of the checking of the respective bank notes performed by the control device 35 switches 24, 26 disposed in the transport system 23 are actuated in order to e.g. store bank notes being in a good state in an output pocket 25, whereas bank notes which are in a poor state can be stored in an output pocket 27 or can be transferred to further processing via the transport system 23.

Figure 2:
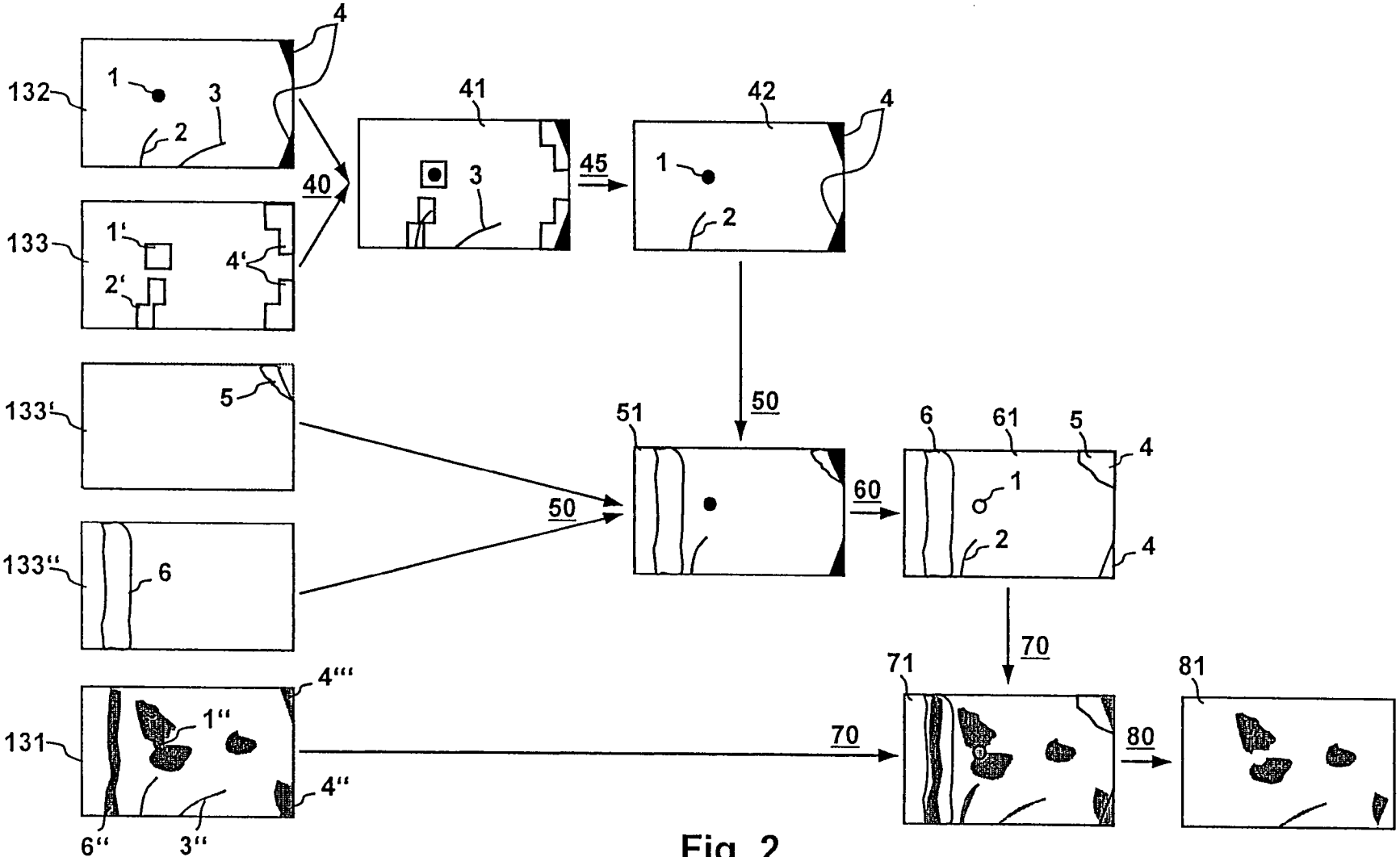
FIG. 2 shows a schematic representation of a checking of a bank note.

FIG. 2 schematically shows a checking of a bank note.

With the check a first property of the bank note is to be determined, e.g. the state of the bank note with respect to the degree of soiling of the bank note. Soiling here in particular means spots, impermissbly added inscriptions etc.

For this purpose, for example, from the data of the first, optical sensor 31, which e.g. captures light of a certain wavelength reflected by the bank note, the control device 35 derives those areas or places on the surface of the bank note, the data of which indicate a soiling. In FIG. 2 the soiled areas or places are marked by dark areas in a representation 131 of the bank note.

Furthermore, at least one second property of the bank note is determined, e.g. the state of the bank note with respect to the degree of damage or destructions of the bank note. Damage or destructions here in particular shall mean holes, tears, defective spots, dog-ears, adhesive tapes etc.

For this purpose, for example, from the data of the second, optical sensor 32, which e.g. captures light of a certain wavelength transmitted by the bank note, the control device 35 derives those areas or places on the surface of the bank note, the data of which indicate a damage or destruction. In FIG. 2 the damaged or destroyed areas or places are marked by black areas 1 to 4 in a representation 132 of the bank note. The area 1 indicates a hole in the bank note, the areas 2 and 3 indicate tears in the bank note and the areas 4 indicate defective spots or dog-ears.

For checking or proving the second property of the bank note (here: damage or destructions) derived from the data of the second, optical sensor 32, the data of the third, acoustic sensor 33 can be used. For this purpose the data of the acoustic sensor 33 additionally can be evaluated in different ways by the control device 35.

When the data of the acoustic sensor 33, which for example detects transmitted ultrasound, are examined as to places with high signal strength, the places on the bank note having holes 1', tears 2' and defective spots 4', as shown in a representation 133, can be derived by the control device 35.

In a step 40 for the purpose of checking or proving the derived holes, tears and defective spots, the holes 1, 1', tears 2, 3, 2' and defective spots 4, 4' determined before (representation 132 and 133) are compared, as shown in a representation 41. It is determined thereby that e.g. the tear 3 detected by the optical sensor 32 has not been detected by the acoustic sensor 33. Therefore, in a next step 45 the control device 35 calculates a representation 42, in which only the hole 1, the tear 2 and the defective spots 4 are contained.

From the data of the acoustic sensor 33, which for example detects transmitted ultrasound, further conclusions can be drawn as to the state of the bank note. When the control device 35 examines the data as to places that have nearly no signal strength, as shown in the representation 133', the places 5 on the bank note having increased thickness or wall thickness can be derived by the control device 35. Such places 5 indicate, for example, the presence of dog-ears. When the data of the acoustic sensor 33 are examined as to places with reduced signal strength, the places 6 on the bank note can be derived by the control device 35 that, for example, indicate the presence of an adhesive tape, as shown in representation 133"

The information about dog-ears 5 and adhesive tapes 6 in a further step 50 is combined with information about the hole 1, the tear 2 and the defective spots 4 by the control device 35 as to form a representation 51, which contains all determined and proved damage or destructions of the bank note.

In a further step 60 a mask 61 is formed by the control device 35, which contains the spatial distribution of the damage or destructions 1, 2, 4, 5, 6, i. e. the places on the bank note to be checked showing the respective damage or destructions.

In a next step 70 the mask 61 is put on the soiled areas or places of the bank note by the control device 35, which during the derivation process of the first property of the bank note to be checked have been derived from the data of the first sensor 31 and are shown in the representation 131. The result is a representation 71, from which appears the spatial or local correlation of the first property (soiling) with the second property (damage or destruction).

For the final evaluation of the soiling of the bank note, the first property characterizing the soiling is derived once again from the data (dark spots in representation 131) of the first sensor 31 by the control device 35, the derivation process from the data being altered.

In such an altered derivation process it may be provided that the data of the optical sensor 31, which locally correlate with the at least second property (damage or destruction), are not taken into account. In this case a last step 80 of the processing performed by the control device 35 results in a representation 81 showing the distribution of soiling on the bank note to be checked, which is taken into account when the first property (soiling) is derived once again. Therefore, places on the bank note to be checked, which by mistake may be evaluated as soiling (holes 1", tears 3", defective spots 4", dog-ears 4", adhesive tapes 6" etc.) are not taken into account, as a result of which the checking of the bank note is improved.

On the basis of the soiling of the bank note shown in representation 81, which is stored in the storage device of the control device 35, a final assessment can be performed by the control device 35 so as to classify the bank note as e.g. soiled, little soiled or not soiled. Such a classification can be used for deciding as to whether the bank note e.g. is still fit for circulation.

In such an altered derivation it may be alternatively or additionally provided that the data of the optical sensor 31, which locally correlate with the at least second property, are processed analogously, e.g. by means of a linear combination. With the altered derivation methods of fuzzy logic can be employed alternatively or additionally. Here the data of the optical sensor 31 can alternatively or additionally be linked with the data of other sensors, always linking data which relate to the same place of the respective bank note to be examined.

With the help of the described correlation of the different data there can be achieved that the result of the checking of the bank notes generally is improved. This is achieved—as described—by the fact that in all cases of inaccuracy or insecurity when judging the state, authenticity, type of bank note etc., instead of solely with reference to data of one sensor, by linking data of one or a plurality of other sensors it is achieved, that the quality of the assessment performed is improved. By this means annoying manual re-processing, i. e. assessment of the bank notes by an operator, becomes superfluous. In this way by using the inventive method or inventive apparatus the rate of rejection of bank notes when processed in a bank note processing machine can be substantially reduced, as a result of which the re-processing is reduced respectively and the throughput of bank notes is increased.

The invention claimed is:

1. Method for checking bank notes, in which data from at least two different sensor measurings of the bank notes to be checked are evaluated, comprising the steps:

deriving a first property of the bank note to be checked from data obtained from at least one first measuring using at least a first sensor, deriving at least one second property of the bank note to be checked from data obtained from at least one second measuring using at least a second sensor, then deriving a correlation between said first property and said at least one second property for the same places on the bank note to be checked to provide combined data related to the first and at least one second properties of the bank note to be checked, and then deriving the first property once again, so that at places on the bank note to be checked, for which said correlation between the first property and the at least one second property was determined, an altered derivation of the first property is effected from the data of the at least first measuring by comparing data obtained from the correlation between the first and at least one second property with the data obtained from the first measuring, and using the result of the comparison to obtain an improved indication of said first property.

2. Method according to claim 1, wherein, when the altered derivation of the first property is effected, data of places used to derive said correlation between the first and at least one second property are not taken into account.

3. Method according to claim 1, wherein, with the measurings, data for at least one side of the bank note to be checked are generated.

4. Method according to claim 3, wherein said data are generated for the complete side of the bank note to be checked.

5. Method according to claim 1, wherein the first property is a soiling condition of the bank notes to be checked.

6. Method according to claim 1, wherein the first measuring is an optical measuring.

7. Method according to claim 1, wherein the at least one second property is a damage condition of the bank notes.

8. Method according to claim 1, wherein the second measuring is an optical and/or acoustic measuring.

9. Apparatus for checking bank notes having at least two sensors, the data of which are evaluated for the checking of bank notes by a control device, comprising;

the control device is arranged to derive a first property of the bank note to be checked from the data obtained from at least one first sensor, the control device is arranged to derive at least one second property of the bank note to be checked from the data obtained from at least one second sensor, the control device is arranged to derive a correlation between the first property and the at least one second property for the same places on the bank note to be checked to provide combined data related to the first and at least one second properties of the bank note to be checked, and the control device is arranged to once again derive the first property, so that at places of the bank note to be checked, for which said correlation between the first and the at least one second property was determined, an altered derivation of the first property is effected from the data of the at least first sensor by comparing data obtained from the correlation between the first and at least one second property with the data obtained from the at least first sensor, and using the result of the comparison to obtain an improved indication of said first property.

10. Apparatus according to claim 9, wherein when the altered derivation is effected, the control device does not take into account data of the at least one first sensor relating to places used to derive said correlation.

11. Apparatus according to claim 9 wherein the sensors are arranged to generate data for at least one side of the bank note to be checked.

12. Apparatus according to claim 11, wherein the sensors are arranged to generate data for the complete at least one side of the bank note to be checked.

13. Apparatus according to claim 9, wherein the first property is a soiling condition of the bank notes to be checked.

14. Apparatus according to claim 9, wherein the at least first sensor is an optical sensor.

15. Apparatus according to claim 9, wherein the at least one second property is a damage condition of the bank notes to be checked.

16. Apparatus according to claim 9, wherein the at least one second sensor is an optical and acoustic sensor, or either an optical or acoustic sensor.

* * * * *

UNITED STATES PATENT AND TRADEMARK OFFICE

CERTIFICATE OF CORRECTION

PATENT NO. : 7,607,528 B2
APPLICATION NO. : 10/539796
DATED : October 27, 2009
INVENTOR(S) : Derks et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1034 days.

Signed and Sealed this

Twelfth Day of October, 2010

David J. Kappos

David J. Kappos
*Director of the United States Patent and Trademark Office*